US005347732A

United States Patent [19]

Padawer

[11] Patent Number: 5,347,732

[45] Date of Patent: Sep. 20, 1994

[54] SCROLL FRAME INCLUDING SLOTS AND FABRIC ENGAGING RODS

[76] Inventor: Robert S. Padawer, 2208 S. Elder Cir., Broken Arrow, Okla. 74012

[21] Appl. No.: 141,512

[22] Filed: Oct. 27, 1993

[51] Int. Cl.[5] ..... D06C 3/08

[52] U.S. Cl. ..... 38/102.4; 38/102.91; 160/395

[58] Field of Search ..... 38/102, 102.1, 102.3, 38/102.4, 102.91; 160/378, 383, 391, 392, 393, 395, 403; 101/127.1

[56] References Cited

U.S. PATENT DOCUMENTS

| | | | |
|---|---|---|---|
| 632,159 | 8/1899 | Steward | 38/120 |
| 1,015,068 | 1/1912 | Pulit | 160/391 |
| 1,277,030 | 8/1918 | Berger | 160/392 X |
| 3,098,280 | 7/1963 | Harris et al. | 38/102.4 |
| 3,859,742 | 1/1975 | Amaro | 38/102.4 |
| 3,987,835 | 10/1976 | Bloomfield | 101/127.1 X |
| 4,345,390 | 8/1982 | Newman | 38/102.91 |
| 4,409,749 | 10/1983 | Hamu | 38/102.3 |
| 4,430,814 | 2/1984 | Wulc | 38/102.91 |
| 4,430,815 | 2/1984 | Wulc | 38/102.91 |
| 4,471,542 | 9/1984 | Umbenhauer | 160/395 X |
| 4,525,909 | 7/1985 | Newman | 29/121.1 |
| 4,539,734 | 9/1985 | Messerschmitt | 24/460 |
| 4,578,885 | 4/1986 | Dang et al. | 38/102.91 |
| 4,658,522 | 4/1987 | Kramer | 38/102.91 |
| 5,018,442 | 5/1991 | Hamu | 38/102.91 X |
| 5,255,455 | 10/1993 | Hopper | 38/102.1 |

*Primary Examiner*—Clifford D. Crowder
*Assistant Examiner*—Ismael Izaguirre

[57] ABSTRACT

A needlework frame of the scrolling variety, created to simplify use, which provides a non-slip method of attachment of the needlework base fabric to the scrolling rods that reduces the possibility of damage to the fabric and/or the accomplished needlework; that makes it possible to easily remove the needlework from, or return it to the frame and; that makes it possible to exert the desired tension upon the fabric without danger of the fabric slipping, distorting or becoming disengaged from either the supply or the take-up rod. This secure grip is provided by the placement of each end of the width of a length of fabric between a pair of parallel dowels which are permanently joined together at their ends, winding the fabric once around one of the joined dowels and over the other and installing the fabric-wound dowels in a corresponding lengthwise trapezoidal slot in each of the scrolling rods, where the application of tension to the fabric, by rotating the rods, causes the dowels to twist in the slot and bind the fabric securely between the dowels and against the sides of the slot.

9 Claims, 2 Drawing Sheets

A–A

SCROLL FRAME INCLUDING SLOTS AND FABRIC ENGAGING RODS

BACKGROUND OF THE INVENTION

The present invention relates to certain improvements to scroll frames which are employed to stretch and maintain fabric, upon which needlecraft or similar arts are accomplished, in a taut condition and facilitate the convenient scrolling advancement of the fabric as the work progresses.

In the creation of needlecrafted articles and the like, it is necessary that the fabric upon which the work is performed be tautly stretched over a frame, chassis or hoop and be maintained in a taut condition throughout the needlework operation, not only to allow the accurate insertion of the needle and the drawing of the thread or yarn, but to provide an undistorted visual perception of the overall work in progress. While the embroidery hoop with a tightly fitting corresponding encirclement, or the small square or rectangular chassis, upon which the fabric is attached by brads or tacks are adequate for "samplers" or works of small dimension, more ambitious projects such as tapestries led to the development of the scrolling frame.

The current state-of-the-art development of the scroll frame for needlework generally consists of a pair of elongated rigid side rails which have bores adjacent the ends thereof which are sized to closely accommodate the passage of scroll rods of a length somewhat greater than the width of the fabric upon which the needlework is to be performed. These rods generally pass through the bores in the side rails where a clamping action to prevent their rotation is provided by the provision of slots in the side rails, which pass through the center of the diameter of the accommodating bores and extend to the ends of the side rails. Machine screw or the like pass perpendicularly through the slots and are generally provided with wing-nuts which may be tightened to cause the slot to close slightly and cause a reduction in the diameter of the accommodating bore causing a clamping action on the scroll rods thus preventing their rotation within the frame rails. The ends of the fabric work-piece are generally attached to the scroll rods by means of brads, staples or tacks, or by stitching to a fabric portion which is adhesively or otherwise fixedly attached along the length of the scroll rod.

A diligent search of the prior art relating to the attachment of fabric to wooden scrolling or tensioning rollers such as are employed in needlecraft frames failed to reveal that any concerted effort has been devoted to the development of that art while much attention had been given to stretch frames of metallic construction for silk-screen processes. Examples of methods of attachment of screen fabric and also of tensioning the fabric are disclosed in U.S. Pat. No. 4,345,390 to Newman U.S. Pat. Nos. 4,430,814 and 4,430,815 to Wulc; U.S. Pat. No. 4,409,749 to Hamu; U.S. Pat. No. 4,525,909 to Newman; U.S. Pat. No. 4,539,734 to Messerschmitt and; U.S. Pat. No. 4,578,885 to Dang et al. It will be noted that the preferred method of attachment in each of these disclosures is by insertion of a fabric wrapped spline into a longitudinal slot in the tensioning roller whereupon tension imposed upon the fabric encourages the spline to twist within the slot to cause the fabric to engage the inner surface of the slot thereby inhibiting slippage of the fabric out of the slot so long as tension is maintained. It will also be noted that the means for rotating the rollers to place the fabric under tension is by the application of a suitable wrench to "flats" provided for that purpose on the ends of the rollers, however, no definitive method is disclosed or illustrated for maintaining that set tension. It is obvious however, that it is not intended that fabric be spooled upon these rollers as they are designed to be rotated for only approximately one-half revolution in opposite directions and are exclusively for tensioning purposes. Amaro in U.S. Pat. No. 3,859,742 disclosed a folding adjustable needlecraft frame and Kramer in U.S. Pat. No. 4,658,522 disclosed a frame for tensioning and supporting textiles for needlework.

OBJECT OF THE INVENTION

It is the object of the present invention to provide an improved frame for the accomplishment of needlework that comprises means to easily and conveniently attach the fabric upon which the needlework is to be performed to a scroll rod; to do so in a manner which is non-destructive or damaging to the fabric; to allow the "spooling-on" of a length of fabric for long workpieces; to provide a second identical scroll rod for the attachment of the distal end of a length of fabric for advancing the fabric for "take-up" and tensioning purposes and; to provide means whereby the fabric may be scrolled from one rod to the other, adjusted for tension and securely maintained under the desired tension without the requirement for tools of any kind.

BRIEF DESCRIPTION OF THE DRAWING FIGURES

Figure 10:
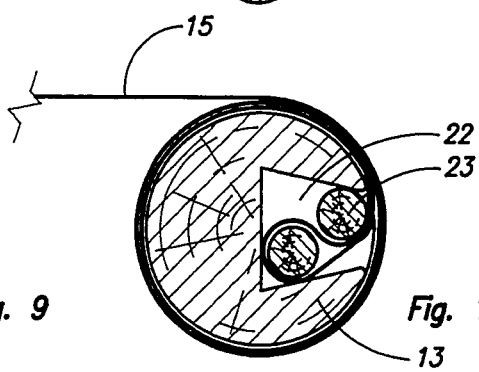

FIG. 10 sectionally depicts the opposing scroll rod with a supply of fabric "spooled-on" as when ready for use in the accomplishment of needlecraft.

THE PREFERRED EMBODIMENT OF THE INVENTION

Figure 1:
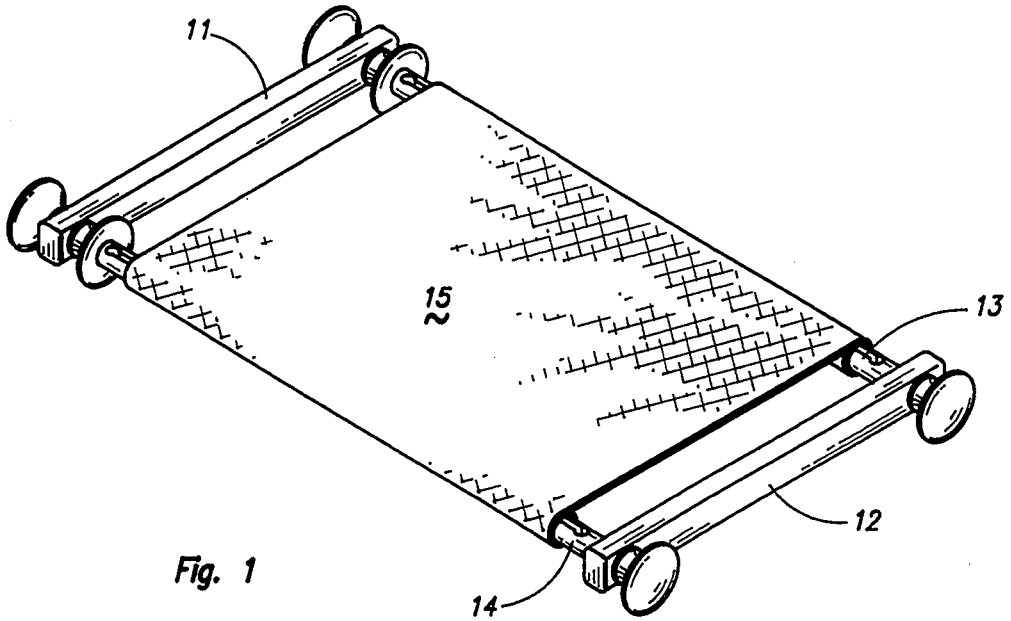
FIG. 1 is an isometric view of a needlework scroll frame as it appears when in use, with fabric spooled upon the supply and take-up scrolling rods, incorporating the improvements of the present invention.
Figure 2:
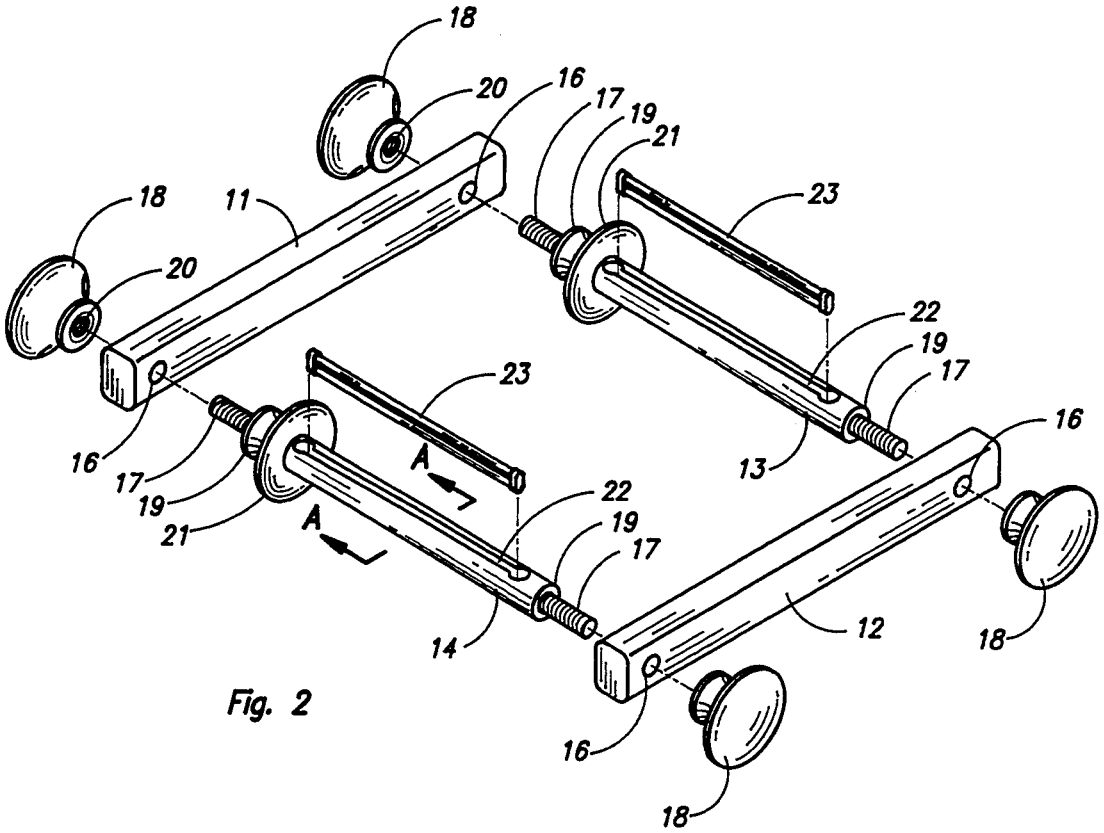
FIG. 2 is an exploded view of a needlework scroll frame illustrating, in greater detail, the construction and manner of assembly of the improved components of the frame.

Referring now, in greater detail to the FIGURES OF THE DRAWINGS which disclose the presently preferred embodiment of the invention as an improved scrolling needlecraft frame, which is of a substantially wooden construction. FIG. 1 pictorially illustrates the overall invention in an assembled and operable form comprising in combination two substantially identical opposed, spaced apart, side members, left side member 11 and right side member 12 and two substantially identical opposed, spaced apart, scroll rod members, which may be of any practical length, upper scroll rod 13 and lower scroll rod 14. Wound upon and extending between said scroll rod 13 and said scroll rod 14 is a section of needlework base fabric 15. FIG. 2 illustrates all of the components of the invention in an exploded view wherein identical side members 11 and 12 are provided, proximate the opposing ends thereof, with transverse bores 16, sized to closely accommodate the passage therethrough of metallic threaded portions 17 of upper and lower wooden scroll rods 13 and 14. Said metallic threaded portions 17 being fixedly attached within accommodating bores (not shown) centered in the opposing ends of said wooden scroll rods 13 and 14 by an epoxy or cyano-acrylate cement or other suitable means. Assembly of the frame is accomplished by inserting the threaded portions 17 of scroll rods 13 and 14 into and through transverse bores 16 in left and right frame side members 11 and 12 where they are secured by threaded engagement with correspondingly threaded metallic inserts 20 fixedly installed in bores in locking knobs 18 which, upon tightening, draw shoulders 19 of scroll rods 13 and 14 into frictional engagement with the inner flat surfaces of frame side members 11 and 12. Locking knobs 18, provided with internal metallic threads 20 for strength and durability, are tightened against the outer flat surfaces of side members 11 and 12 to cause frictional locking engagement at the point of conjunction of shoulders 19 and the inner flat surfaces of left and right side frame members 11 and 12 and thereby prevent the rotation of scroll rods 13 and 14. A fixedly attached scrolling and tensioning knob 21 is provided proximate one end of each wooden scroll rod to permit the convenient rotation of each rod for the purpose of winding-on, taking-up and to provide purchase for tensioning the fabric 15 as it is illustrated in FIG. 1.

Figure 3:
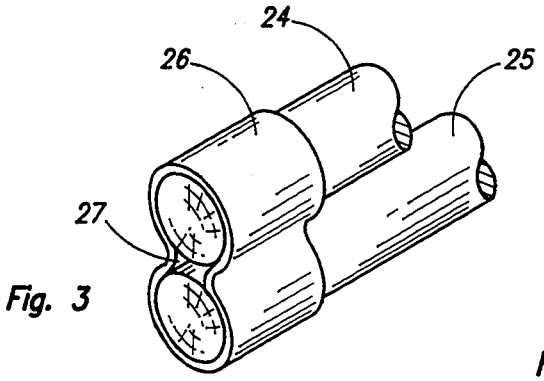
FIG. 3 is a detail view of the structural assembly of the pinch locking dowels illustrating the manner in which they are spaced apart by a compressed ferrule.
Figure 4:
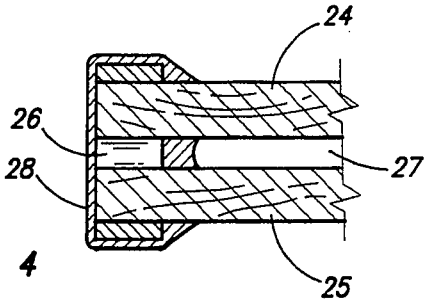
FIG. 4 is a sectional view of the pinch locking dowels and compressed ferrule of FIG. 3 following encapsulation.

Another unique feature of the present invention is the manner in which the fabric is attached to and restrained from axial slippage upon, or departure from, the scroll rods without damage to the fabric from stitching, tacking or cementing the fabric to the scroll rods. This is accomplished by the employment of a "pinch-locking" system which securely and firmly grips and retains the fabric and prevents its departure from or slippage upon the scroll rods. A trapezoidally or dove-tail slotted area 22, in each of scroll rods 13 and 14, accommodates the entry of a fabric gripping assembly generally designated as 23 which is shown to advantage in FIG. 3 through FIG. 9. Fabric gripping assembly 23 consists of two identical dowels 24 and 25 which are fixedly joined in a parallel relationship at the opposing ends thereof by a metallic ferrule 26, in FIG. 3, which is centrally crimped or pressed, by the use of a special tool and die set to a configuration somewhat resembling the numeral "8," about the periphery of the ends of said dowels 24 and 25. A small quantity of cyano-acrylate or similar adhesive is applied to the area of said dowels which are encompassed by said ferrules prior to the crimping operation to assure a secure and permanent bond. A narrow space 27, of a dimension approximating the thickness of needlework base fabric, (exaggerated in these FIGURES for purposes of clarity) is provided between the two dowels to facilitate the entry of said fabric therebetween. In the preferred embodiment, following the crimping operation, the ends of the conjoined dowels are dipped to a depth slightly in excess of the width of the crimped ferrule 26 in an air-setting plastic compound 28, FIG. 4, to further assure their joined integrity and to cover any edges which may damage the needlework or cause personal injury.

Figure 5:
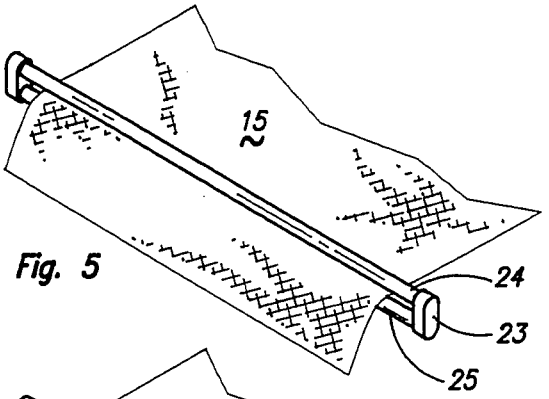
FIG. 5 illustrates the fabric path between the pinch locking dowels.
Figure 6:
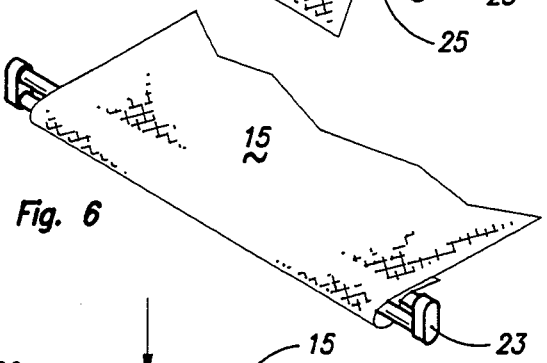
FIG. 6 illustrates the fabric path following a one revolution rotation of the pinch locking dowel assembly.
Figure 7:
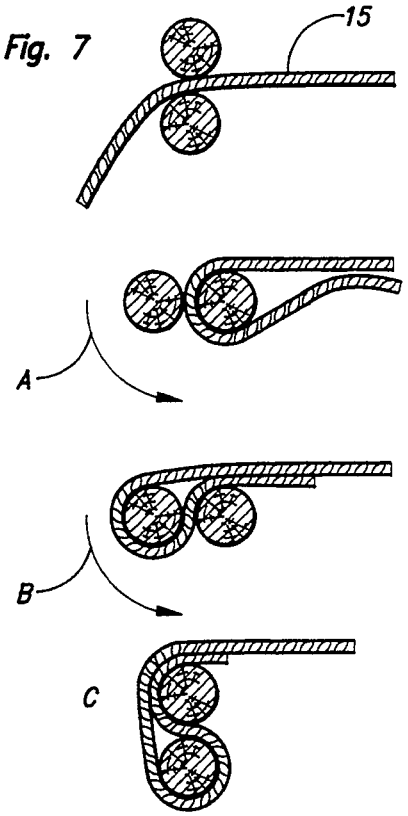
FIG. 7 illustrates in sequential sectional view the fabric path through and about the pinch locking dowel assembly from insertion of the fabric through one-quarter, three-quarters and one complete revolution.

FIG. 5 illustrates the manner in which the needlework base fabric is inserted between dowels 24 and 25 of the fabric gripping assembly 23 and FIG. 6 illustrates the position of the fabric following one complete rotation of said fabric gripping assembly. The path of the fabric between, over and around the dowels of the fabric gripping assembly is illustrated to advantage in FIG. 7, which depicts in rotational sequence, the path of the fabric 15 at insertion, at one-quarter A, three-quarters B and at one full revolution C.

Figure 8:
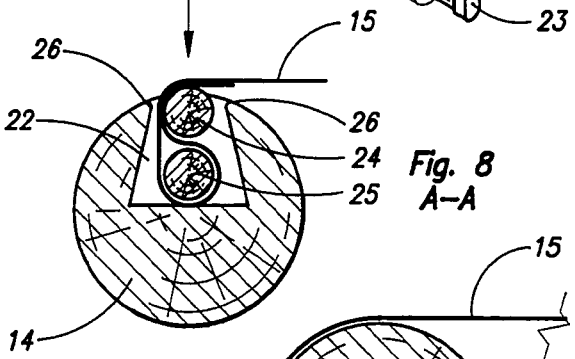
FIG. 8 depicts, in sectional view, the insertion of the pinch locking dowel assembly into the trapezoidal or dove-tail slot in a scroll rod.
Figure 9:
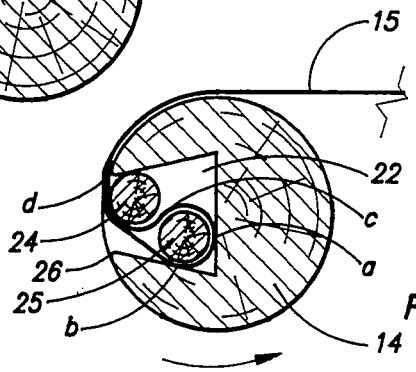
FIG. 9 illustrates, in sectional view, the locked position of the pinch locking dowel assembly in the trapezoidal or dove-tail slot and the path of the fabric upon application of tension.

The sectional view in FIG. 8 of scroll rod 14, (which is identical to scroll rod 13) taken at A—A in FIG. 2, shows to advantage the trapezoidal or dove-tail slot 22 which is provided to accommodate fabric gripping assembly 23, which comprises dowels 24 and 25, and illustrates the manner in which the fabric wrapped assembly 23 is inserted into said slot 22. FIG. 9 illustrates the manner in which the fabric gripping assembly is encouraged into engagement with the walls of slot 22 causing gripping pressure to be applied to the entire width of fabric 15 at points a, b and c as the scroll rod 14 is rotated to bring the fabric under tension. The greater the tension applied, the greater the resultant gripping force. It is to be noted that upper edges of slot 22 are relieved by the provision of a short radius 26 along the entire length of said slots at their points of conjunction with the periphery of the scroll rods thus providing a smooth rounded edge which will not cause damage to the fabric. It should also be noted that the entire path of the fabric 15 around and about the gripping assembly and scroll rods is without either sharp bends or creases which may be damaging to the fabric. It should also be further noted that in the passage of the fabric over the short radius 26 only the extreme end of the length of fabric is exposed to contact at point d, thus limiting any damage which might occur at this point to only the extremity of the fabric.

The sectionalized view of FIG. 10 depicts the opposing scroll rod 13 with a supply of fabric wound thereon and shows the manner in which the fabric gripping assembly 23 is reversely threaded and wound and is urged to the opposite side of slot 22 of scroll rod 13 to resist slippage from oppositely applied tension.

SUMMARY OF THE INVENTION

The present invention is not an attempt to re-invent the scrolling frame as it is employed in the needlecraft arts, but to provide much needed improvements thereto which simplify and facilitate its use and improve its durability.

Traditional needlecraft frames and those of the current state-of-the-art are subject to frequent failure at the point where a slot traverses the bore which is provided in the side rails to accommodate the diameter of the scroll rods. The employment of a slot in the frame side members, to permit a clamping action upon the scroll rods to prevent their rotation under tension, also requires a transverse bore perpendicular to the scroll rod proximate the end of the side member to accommodate a screw or bolt which frequently requires the use of tools to tighten or loosen. The removal of stock required to accommodate the diameter of the scroll rods, the slot and the additional bore to allow gripping closure upon the scroll rods reduces the strength of the side rails and mandates a compensatory dimensional augmentation, thus increasing the size and weight of the frame and reducing the utility thereof.

The present invention provides three notable improvements over that system in that; 1) less stock need be removed to accommodate the passage of the metallic threaded portions 17 than is required to allow the passage of the larger diameter of the scroll rod thereby permitting the use of material of a lesser dimension and weight thus increasing utility and convenience; 2) the metallic threaded portions are "journaled" and permitted to turn freely in the frame side members thus facilitating "spooling-on" and scrolling of the fabric and; 3) positive locking and unlocking to prevent or provide rotation of the scroll rods through frictional engagement or disengagement of the shoulders 19 of the scroll rods with the flat inner sides of the frame members, said engagement being made possible by the provision of internally threaded, hand grippable knobs 18 which allow manual tightening into compression against the outer flat sides of the frame members, obviating the requirement for tools of any kind.

Scroll rods of the current art employ various means for the attachment of fabric and include: split dowels through which the end of a length of fabric is passed and turned back under itself for frictional retention; dowels having a narrow slot into which the end of a length of fabric is inserted and retained by a fluted spline; adhesively attached basting strips to which a length of fabric is basted or stitched and; tacks staples or brads driven through the end of a length of fabric into the scroll rod or dowel. While each of these methods, more or less, effectively attach the fabric to the scroll rod, they do so at the expense of damage to the fabric, for each of these methods requires that the fabric be sharply creased or folded and pass over sharp edges or be pierced in numerous locations. In the event that the needlework begins near the end of the fabric, any damage to the end of the base fabric can easily be transferred or "telegraphed" into the area of the needlework proper causing distortion of the design and ultimately, the destruction of many hours of the needlecrafter's work Further, currently employed scroll rods have no provision for their rotation to "spool-on" fabric to the supply rod, to "scroll" fabric between the supply and take-up rod and no provision for bringing the fabric into a taut condition between the rods, other than by grasping the rods (and consequently the needlework itself) in the hands and twisting to achieve the desired tension. It will readily be seen that such action is also potentially damaging to the accomplished needlework.

The improvements of the present invention allow the secure attachment and retention of the needlework base fabric to both the supply and take-up scroll rods in such a manner that the fabric may be installed without creasing, folding, stapling, stitching or reliance upon sharp edges and right angles by providing a pinch-locking assembly which allows ready alignment and securely, yet gently, grips the fabric along its entire width at three points as it passes over and around circular dowels and the smoothly rounded edges of a trapezoidally configured longitudinal slot. This method of attachment makes it possible to remove an entire needlework-piece from the frame at any time and re-install it without damage or difficulty. Scrolling knobs 21 fixedly attached to scroll rods 13 and 14 provide a convenient and simple means for rotating said rods for "spooling-on" fabric, scrolling between rods and imparting tension to the fabric between said rods and locking of the rods in place by the simple expedient of manually tightening locking knobs 18.

With these improvements in place an artisan is thus prepared for many pleasant and problem-free hours, days and years in the practice of the art of needlecraft with a convenience and facility never before possible.

While there have herein been disclosed, illustrated and explained, a number of improvements to scroll frames for needlework and the like, it should be understood that such has been done for the purpose of illustration only and that certain modifications, alterations and other improvements may be made thereto within the scope of the appended claims.

What I claim is:

1. A needlecraft frame retaining and tensioning rods for attachment, scrolling or spooling upon, tensioning and advancement of the fabric upon which needlecraft is performed, employing a pair of identical, opposed, spaced-apart, rotatable, cylindrical wooden rods adaptable to needlecraft frames, of various design, comprising in combination:

a) a pair of spaced apart, cylindrical wooden rod means, for rotatable positioning between and at right angles to the opposed side frame members of conventional needlecraft frames, adjacent the upper and lower ends thereof, said rods being rotatably and lockably attachable in any acceptable manner, said rods being of a length greater than the width of the needlecraft base fabric and of sufficient length to traverse the distance between the opposing sides of a conventional needlework frame;

b) longitudinal slot means, of a trapezoidal configuration, having a wide base, inwardly angled walls of equal length and a narrow top opening at the periphery of said rod, situate in and along a portion of the length of each of said rods, said slot being of a length greater than the width of the needlecraft fabric and lesser than the length of said rod, said slot being accommodative of the entry thereinto of;

c) slot insertable fabric gripping means comprising a pair of parallel spaced apart wooden dowels of a longitudinal dimension slightly in excess of the width of the base needlework fabric, said dowels being conjoined by metallic ferrule means, at the opposing ends thereof, and adapted to accommodate the passage therebetween of and engagement with the ends of the fabric base cloth, whereupon on a one revolution rotation of said conjoined wooden dowels about said base fabric configures the assembly for insertion into and engagement with said longitudinal trapezoidally configured slot in said wooden cylindrical rod means, whereupon rotation of said rod means imparts a partial rotation to said conjoined dowels and causes the engagement of said base fabric with the internal surfaces of said trapezoidal slot, a short raduis at the upper extremity thereof and the oppositely urged fabric, effecting a greater gripping force as tension on said base fabric is increased, resulting in a secure, non-damaging, yet readily-releasable-on-demand gripping engagement over the entire width of said needlecraft base fabric as said cylindrical rod means are rotated to scroll on, advance and tension said base fabric as is required in the accomplishment of needlecraft.

2. The scrolling rods of claim 1 wherein said longitudinal dimensioned slots are of a trapezoidal configuration.

3. The slot insertable fabric gripping means of claim 1 comprising parallel, mechanically conjoined dowels.

4. The conjoined dowels of claim 3 wherein said dowels are mechanically spaced apart.

5. The mechanically conjoined dowels of claim 3 wherein said conjoinment comprises crimped metallic ferrule means at the opposing ends thereof.

6. The mechanically conjoined dowels of claim 3 wherein fabric to be retained passes therebetween.

7. The cylindrical wooden scroll rods of claim 1 wherein said rod means, said longitudinal slot means and said slot insertable fabric gripping means are employable in pairs of any practical length to accommodate needle craft base fabric of various widths.

8. The slot insertable fabric gripping means of claim 1 a) wherein said metallic ferrule conjoinment means at the opposing ends of said conjoined dowels is provided with a plastic sheath means for the purposes of:

a) assurance of the spaced-apart joined integrity of said parallel dowels;

b) prevention of damage to the needlecraft base fabric or the needlework and;

c) prevention of personal injury to a user.

9. The longitudinal, trapezoidally configured slot of claim 1 b) wherein the outer peripheral longitudinal edges of said slot are rounded to prevent damage to the needlecraft base fabric or the needlework.

* * * * *